US006291055B1

(12) United States Patent
Krauter

(10) Patent No.: US 6,291,055 B1
(45) **Date of Patent: *Sep. 18, 2001**

(54) THERMO-TRANSFER RIBBON

(75) Inventor: Heinrich Krauter, Turriff (GB)

(73) Assignee: Pelikan Produktions AG (CH)

( * ) Notice: Subject to any disclaimer, the term of this patent is extended or adjusted under 35 U.S.C. 154(b) by 0 days.

This patent is subject to a terminal disclaimer.

(21) Appl. No.: 09/306,368

(22) Filed: May 6, 1999

(30) Foreign Application Priority Data

May 8, 1998 (DE) ..... 198 20 779

(51) Int. Cl.[7] ..... B41M 5/10

(52) U.S. Cl. ..... 428/195; 428/488.4; 428/913; 428/914

(58) Field of Search ..... 428/195, 488, 428/488.1, 488.4, 913, 914

(56) References Cited

U.S. PATENT DOCUMENTS 5,219,610 * 6/1993 Koshizuka et al. ..... 427/152
5,484,644 * 1/1996 Imamura et al. ..... 428/195
6,074,760 * 6/2000 Krauter ..... 428/488.4

FOREIGN PATENT DOCUMENTS 195 48 033 A1 7/1997 (DE) .
196 12 393 A1 10/1997 (DE) .
01 33 638 B1 6/1984 (EP) .
1-38 271 5/1989 (JP) .

* cited by examiner

*Primary Examiner*—Bruce H. Hess
*Assistant Examiner*—Michael E. Grendzynski
(74) *Attorney, Agent, or Firm*—Fay, Sharpe, Fagan, Minnich & McKee, LLP

(57) ABSTRACT

Description of a thermo-transfer ribbon with a customary carrier having a wax-bonded layer of a thermo-transfer color on one side of the carrier and with a wax-bonded separation layer located between carrier and the wax-bonded layer. The thermo-transfer ribbon distinguishes itself in that the wax-bonded layer B) of the thermo-transfer color contains a wax-soluble polymer and the wax-bonded separation layer A) contains less than approximately 20% by weight of a polymer wax plasticizer and has a glass temperature Tg of −30 to +70° C. The benefits of said thermo-transfer ribbon are based in that the print quality as well as the scratch and solvent resistance are excellent.

17 Claims, No Drawings

THERMO-TRANSFER RIBBON

The invention relates to a thermo-transfer ribbon having a customary carrier with a wax-bonded layer of a thermo-transfer color formed on one side of the carrier and a wax-bonded separation layer arranged between the carrier and wax-bonded layer.

A thermo-transfer ribbon of the above described type is known from DE 195 48 033 A1. The wax-bonded separation layer described in same serves for improved separation of the wax-bonded layer from the respective carrier. It is the particular goal of said teaching to exclude the necessity of forming a so-called "top coat" (adhesive layer) or a dual-layered thermo-transfer color, and to achieve satisfactory matt print-outs during the thermo-print process. This is achieved by both the wax-bonded separation layer as well as the wax-bonded layer of the thermo-transfer color containing a wax-soluble polymer in sufficiently large quantity. The wax-bonded layer of the thermo-transfer color preferably contains approximately 2 to 20% by weight of wax-soluble polymer and the separation layer 10 to 60% by weight.

The above described thermo-transfer ribbon is highly suited to meet the stated goal. However, if the goals are different, it requires improvement. An increasingly greater role is played by the so-called "inline packaging" print process, in which printing speeds from 300 to 600 mm/sec are employed. The utilized thermo-transfer ribbons must satisfy different requirements in such process: they must be deployable on standard and high-speed printers with conventionally employed print heads. Concurrently, the thermo-transfer ribbon shall present excellent print quality even with printing speeds of up to 600 mm/sec.

With respect to the known state of the art products which satisfy these mentioned prerequisites, there still remains the problem of obtaining good scratch resistance. The desired solvent resistance of these ribbons is also inadequate. There is no product on the market as yet which satisfies these requirements.

Therefore, it is an object of the invention to propose a thermo-transfer ribbon of the initially identified type whereby the above addressed goals can be achieved relative to improvement of print quality and also with respect to scratch and solvent resistance. The thermo-transfer ribbon shall have multiple applications and be equally suitable for standard and high speed printers having conventional print heads.

According to the invention, the object is achieved in that the wax-bonded layer B) of the thermo-transfer ribbon contains a wax-soluble polymer and that the wax-bonded separation layer A) contains less that approximately 20% by weight, specifically 3 to approximately 8% by weight, of wax-insoluble polymer, whereby the wax-insoluble polymer possesses wax-plastifiable properties and has a glass temperature Tg of −30° to +70° C.

A separation layer or release layer in this context means a layer which regulates the transfer of the thermo-transfer color to the receiving substrate during the printing process and which is itself partially transferred to the substrate.

The separation layer A) and also layer B) of the thermo-transfer ribbon are wax-bonded layers.

A central characteristic of the thermo-transfer ribbon according to the invention consists in that layer B) of the thermo-transfer color contains a wax-soluble polymer in the form of an ethylene-vinylacetate-copolymer. The term "wax-soluble" in this context means that this polymer is soluble in liquid wax. This does not necessarily involve "genuine solutions" but mostly stable dispersions. The result is that during the cooling of such polymer solution in wax there will be no phase separation or that said polymer is compatible with the wax.

The wax-soluble ethylene-vinyl-acetate-copolymer has a softening point in the range of approximately 50° to 65° C., specifically 60° C. In order to increase the adhesion between the separation layer A) and the layer B), the ethylene-vinylacetate-copolymer preferably has a vinyl-acetate content of approximately 30 to 40% by weight.

Layer B) contains ethylene-vinylacetate-copolymer, preferably in volume of approximately 10 to 40% by weight, specifically of approximately 12 to 20% by weight. If the value falls below 10% by weight, the scratch resistance on the packing material is no longer assured. A value in excess of 40% by weight leads to inadequate dissolution of printed symbols.

By using an ethylene-vinylacetate-copolymer, specifically with a low softening point in the range of approximately 60° C. and a vinylacetate percentage of more than 30% by weight, good mechanical anchoring is obtained and thus excellent print quality on the employed foil- and paper acceptance materials.

The waxes employed in the separation layer A) and layer B) within the scope of the invention agree with the customary definition for wax, whereby "narrowly cut" waxes are preferred, in other words melting- and coagulation point of the waxes must lie close together. In particular, waxes are employed having a melting point of approximately 75 to 90° C. In the broadest sense this involves material which is solid to brittle hard, coarse to finely crystalline, transparent to opaque, but which is not glass-like, which melts above approximately 70° C., but which is, however, only slightly above the melting point of relatively low viscosity without being stringy. Waxes of this type are classified as natural waxes, chemically modified waxes and synthetic waxes. Specifically preferred among the natural waxes are vegetable waxes in form of carnauba wax, candelilla wax, mineral waxes in form of higher-melting ceresin and higher-melting ozocerite ( earth wax), petrochemical waxes, such as for example petrolatum, paraffin waxes and micro-waxes. Preferred among the chemically-modified waxes are in particular montan-ester waxes, hydrated castor oil and hydrated jojoba oil. Preferred among the synthetic waxes are polyalkylene-waxes and polyethylene-glycol waxes including products made from same via oxidation and/or esterification. Amide waxes can likewise be utilized. To be mentioned here as particularly preferred are modified micro-crystalline waxes.

Multiple additives can be incorporated in the wax materials of the wax-bonded thermo-transfer color, such as specifically tackifiers in form of terpene phenol resins (such as, for example, the commercial products Zonatac lite 85 made by Arizona Chemical) and hydrocarbon resins (such as, for example, the commercial products KW-r 61 B1/105 made by VFT, Frankfurt). An adhesive layer with tackifier can be applied on layer B). In one specific embodiment, an adhesive layer is positioned on layer B), specifically a paraffin layer with a contents of finely distributed tackifying hydrocarbon resin, with the paraffin having a melting point of specifically 60 to 95° C. Tinting can be done by any coloring substances. These may involve pigments, such as specifically carbon black, but also solvent-soluble and/or binder-soluble coloring substances, like the commercial product Basoprint, organic color pigments as well as various azo dies (Cerces- and Sudan dies). Carbon black is considered as particularly suitable within the scope of the present invention. The thermo-transfer color preferably receives the coloring substance, specifically pigment, in a volume of approximately 15 to 40% by weight. The melting point of the wax-bonded thermo-transfer color lies preferably between approximately 60 and 70° C.

The use of ethylene-vinyl-co-polymer in volume of approximately 30% by weight and a carbon black percentage of approximately 20% by weight in layer B) may result in high viscosity which detrimentally affects the processing. The separation layer A) and/or the layer B) is then coated with a solvent. A mixture of isopropanol and toluol, which is preferably employed at a ratio of 2:1, is suitable for this step. The application thickness of the separation layer A) and of layer B) is not critical. The separation layer A) preferably has an application thickness of approximately 0.5 to 5 g/m$^2$, specifically approximately 1.5 to 3 g/m$^2$, and layer B) has an application thickness of approximately 1.0 to 5 g/m$^2$, specifically 1.5 to 2.5 g/m$^2$.

The carrier of the color ribbon according to the invention is not critical. Polyethylene-terephthalate foils (PET) or capacitor tissues are preferably used as basic foil for thermo-transfer ribbons. Selection parameters are highest possible tension/elongation values and thermal stability with small foil thickness. PET foils can be obtained as thin as approximately 2.5 $\mu$m, capacitor paper as thin as approximately 6 $\mu$m. During the printing process, the thermo print head reaches temperatures of up to 400° C., i.e. temperatures which lie above the softening point of PET. If PET foils are employed, it is suggested to provide a layer of particularly heat-resistant material on the reverse side of the foil which comes into contact with the thermo head.

A beneficial refinement of the inventive idea, specifically for obtaining a beneficially sharp-edged print, is based on an incorporation of the teaching of EP-B-0 133 638. Accordingly, on the reverse side of the carrier a layer is formed of wax or a wax-like material, specifically with a thickness of not more than approximately 1 $\mu$m and most specifically preferred in form of a molecularly shaped layer having a thickness of approximately 0.05 to 0.10 $\mu$m. The coating material in this case preferably consists of paraffin, silicone, natural waxes, specifically carnauba wax, bees wax, ozocerite and paraffin wax, synthetic waxes, specifically acid waxes, ester waxes, partially saponified ester waxes and polyethylene waxes, glycoles or polyglycole, antistatic substances and/or tensides. If such coating is provided on the reverse side, then undisturbed heat transfer takes place from the thermo print head to the thermo-transfer ribbon resulting in particularly sharp-edged prints. This thin layer is preferably coated with one of the above specified solvents.

The thermo-transfer ribbon according to the invention described above can be manufactured in many ways using customary application processes. It can be done, for example, by spraying on or printing on a solution or dispersion, either with water or an organic solvent as dispersion or dissolution agent, by application from melted state, which applies particularly with respect to the wax-bonded thermo-transfer color, or also by normal application via wiper-blade in form of a watery suspension with finely therein distributed coating material.

From an environmental protection aspect, the following method has proven itself as particularly beneficial: To start with, a watery suspension of the raw materials of the separation layer are applied in a thin coating on the carrier, which, upon evaporation of the water, permits the formation of the separation layer A). The formation of the separation layer A) is followed by an application of a watery suspension of the raw material of the wax-bonded thermo-transfer color, whereby the water is evaporated in customary fashion, after application of this material. The developed double-layered coating satisfies all requirements which lie within the scope of the specified object. It is, however, also possible to apply the thermo-transfer color onto the separation layer in form of melted material according to customary application technologies, for example with a wiper-blade. The temperature of the respective melt should generally range between 100 and 130° C. After the coating, the applied materials are permitted to simply cool down.

For the practical or particularly beneficial realization of the present invention, it is possible to specify the following basic conditions with respect to application volumes of the individual layers or their application thickness: Thermo-transfer color layer B): approximately 1 to 10 g/m$^2$, preferably approximately 1.5 to 5g/m$^2$, most specifically preferred 1.8 to 2.0 g/m;$^2$ Separation layer A) approximately 0.5 to 5 g/m$^2$, preferably approximately 1.5 to 3.0 g/m$^2$, most specifically preferred 1.6 to 2.8 g/m$^2$; Carrier foil, specifically polyethylene-terephthalate foil having a thickness of approximately 2 to 8 $\mu$m, specifically a thickness of approximately 3.5 to 4.5 g $\mu$m, including reverse side coating with an application thickness of approximately 0.01 to 0.30 $\mu$m, specifically of approximately 0.05 to 0.10 $\mu$m. Layer B), separation layer A) and the reverse side coating are preferably applied in a solvent.

The benefits relative to the invention must be specifically seen in that the ethylene-vinylacetate-copolymerisate, present only in layer B), having a softening point in the range of 50 to 65° C. and specifically having a vinyl-acetate content of approximately 30% by weight, causes strong mechanical anchoring of the thermo-transfer color to the receiver material, resulting in outstanding print quality. Simultaneously, the wax-bonded separation layer A), which is jointly transferred by up to 80% during the printing process, leads to an unexpectedly high scratch resistance as well as solvent resistance.

The benefits are specifically attained in that layer B) is firmly anchored mechanically on the receiver paper and that concurrently up to 80% of the separation layer A) is jointly transferred. Only thus is it possible to attain the combination of the above described properties.

In the following, the description is explained in more detail, making use of examples:

EXAMPLE 1

On a customary carrier of polyester, having a layer thickness of approximately 6 $\mu$m, a material of the following recipe is applied via wiper-blade for the formation of a wax-bonded separation layer A):

| | |
|---|---|
| Carnauba wax (melting point 83–85° C.) | 95% by weight |
| Polyester resin (Tg = 4° C.) | 5% by weight |
| | 100% by weight |

The above material is applied in a solvent-dispersion (approx. 10%, in toluol/isopropanol 80:20) with a dry thickness of approximately 1.0 to 2.0 $\mu$m. Evaporation of the solvent takes place by passage of hot air at a temperature of approximately 100° C.

Subsequently, the thermo-transfer color B) is applied, using the following recipe in form of a solvent dispersion (approximately 15% in toluol/isopropanol 30:70) using reverse-roll print. Recipe for thermo-transfer color B):

| | |
|---|---|
| Paraffin wax | 50% by weight |
| Petrolite WB 17 | 5% by weight |
| EVA 33400 | 15% by weight |
| filler material | 15% by weight |
| colored carbon | 15% by weight |
| | 100% by weight |

EXAMPLE 2

Example 1 was repeated with the modification in that the following recipe was used for the separation layer A) and the color layer B): Separation Layer A):

| | |
|---|---|
| Ester wax (melting point 80–85° C.) | 72% by weight |
| Paraffin HNP | 20% by weight |
| Polyester resin (Dynapol Huels AG, D-Tg: −28° C. | 8% by weight |
| | 100% by weight |

Transfer Color Layer B)

| | |
|---|---|
| Paraffin wax | 40% by weight |
| Petrolite WB 17 | 12% by weight |
| Zonatac lite 85 | 7% by weight |
| EVA 33-400 | 14% by weight |
| filler material | 7% by weight |
| colored carbon | 20% by weight |
| | 100% by weight |

The two thermo-transfer ribbons manufactured according to examples 1 and 2 were tested on high velocity printers and so-called "inline packaging" printers with printing speeds of 300 to 600 mm/sec and the print results were evaluated. In both cases, excellent print quality was obtained with concurrent outstanding scratch- and solvent resistance.

What is claimed is:

1. Thermo-transfer ribbon comprised of a carrier having a wax-bonded separation layer A) located between the carrier and a wax-bonded layer B), wherein the wax-bonded layer B) comprises a coloring substance and 12 to 20% by weight of an ethylene-vinyl-acetate copolymer and that the wax-bonded separation layer A) contains less than 20% by weight of wax-insoluble polymer, whereby the wax-insoluble polymer possesses wax-plasticising properties and has a glass temperature Tg of −30 to +70° C.

2. Thermo-transfer ribbon according to claim 1, characterized in that the ethylene-vinyl-acetate-copolymer has a vinyl-acetate content of approximately 30 to 40% by weight.

3. Thermo-transfer ribbon according to claim 2, characterized in that the ethylene-vinyl-acetate-copolymer has a softening point of approximately 60° C.

4. Thermo-transfer ribbon according to claim 2, characterized in that the ethylene-vinyl-acetate-copolymer has a softening point in the range of approximately 50 to 65° C.

5. Thermo-transfer ribbon according to claim 1, characterized in that at least one of the wax-bonded layer B) and the separation layer A) are coated with a solvent.

6. Thermo-transfer ribbon according to claim 5, characterized in that the solvent is isopropanol and/or toluol.

7. Thermo-transfer ribbon according to claim 1, characterized in that the separation layer A) has an application thickness of approximately 0.5 to 5 g/m$^2$.

8. Thermo-transfer ribbon according to claim 1, characterized in that the layer B) has an application thickness of approximately 1 to 5 g/m$^2$.

9. Thermo-transfer ribbon according to claim 1, characterized in that the coloring substance has a volume of 15 to 40% by weight.

10. Thermo-transfer ribbon according to claim 9, characterized in that the color substance is carbon black.

11. Thermo-transfer ribbon according to claim 1, characterized in that a thin layer of wax or a wax-like material is arranged on the reverse side of the carrier, having an application thickness of approximately 0.01 to 0.30 $\mu$m.

12. Thermo-transfer ribbon according to claim 1, characterized in that the carrier is made of polyethylene-terephthalate.

13. Thermo-transfer ribbon according to claim 1, characterized in that wax-bonded separation layer A) contains between approximately 3 to 8% by weight of wax-insoluble polymer.

14. Thermo-transfer ribbon according to claim 1, characterized in that the separation layer A) has an application thickness of approximately 1.5 to 3 g/m$^2$.

15. Thermo-transfer ribbon according to claim 1, characterized in that the layer B) has an application thickness of approximately 1.5 to 2.5 g/m$^2$.

16. Thermo-transfer ribbon according to claim 1, characterized in that the thermo-transfer color contains a pigment in a volume of approximately 15 to 40% by weight.

17. Thermo-transfer ribbon according to claim 1, characterized in that a thin layer of wax or a wax-like material is arranged on the reverse side of the carrier, having an application thickness of approximately 0.05 to 0.10 $\mu$m.

* * * * *